US011600250B2

(12) United States Patent
Sikra

(10) Patent No.: US 11,600,250 B2
(45) Date of Patent: Mar. 7, 2023

(54) THROW-OFF DEVICE

(71) Applicant: Drum Workshop, Inc., Oxnard, CA (US)

(72) Inventor: Rich Sikra, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 60 days.

(21) Appl. No.: 17/148,390

(22) Filed: Jan. 13, 2021

(65) Prior Publication Data

US 2021/0217391 A1 Jul. 15, 2021

Related U.S. Application Data

(60) Provisional application No. 62/961,638, filed on Jan. 15, 2020.

(51) Int. Cl.

| | |
|---|---|
| ***G10D 13/18*** | (2020.01) |
| ***G10D 13/02*** | (2020.01) |
| ***H01F 7/02*** | (2006.01) |

(52) U.S. Cl.

CPC ..... *G10D 13/18* (2020.02); *G10D 13/02* (2013.01); *H01F 7/02* (2013.01)

(58) Field of Classification Search

CPC ..... G10D 13/18; G10D 13/02; H01F 7/02

See application file for complete search history.

(56) References Cited

U.S. PATENT DOCUMENTS

| | | | | |
|---|---|---|---|---|
| 7,700,864 | B1 | 4/2010 | Sikra | |
| 7,902,444 | B1 * | 3/2011 | Good | G10D 13/02 84/411 R |
| 8,143,507 | B2 | 3/2012 | Good et al. | |
| 9,633,634 | B2 * | 4/2017 | May | G10D 13/18 |
| 2018/0204550 | A1 | 7/2018 | Steinhauser | |

* cited by examiner

*Primary Examiner* — Jianchun Qin

(74) *Attorney, Agent, or Firm* — Ferguson Case Orr Paterson

(57) ABSTRACT

Described herein are percussion instruments and drums, such as snare drums. The drums include a throw-off device with a handle attached to a mount, which itself can be attached to a drum sidewall. One of the handle and the mount includes a magnet while the other includes a magnetic portion for magnetic engagement with the magnet. The magnetic engagement can be used to bias the handle toward or into a desired position.

19 Claims, 5 Drawing Sheets

THROW-OFF DEVICE

CROSS-REFERENCE TO RELATED APPLICATION

This application claims the priority benefit of U.S. Provisional Pat. App. No. 62/961,638 to Sikra, filed on Jan. 15, 2020 and entitled "Throw-Off Device for a Drum," which is fully incorporated by reference herein in its entirety.

BACKGROUND OF THE DISCLOSURE

Field of the Disclosure

This disclosure relates generally to instruments, and more particularly to percussion instruments such as snare drums, which include an auxiliary device, such as a snare, which cooperates with an instrument body to produce a desired sound; and even more particularly relates to throw-off devices for snare drums.

Description of the Related Art

Snare drums are commonly used in music to create desired sounds. A snare typically comprises a series of wires that typically connect on one or both ends to a fitting. The snare is on or proximate a bottom drum head of the snare drum and extends substantially across the diameter of the bottom drum head from one end to another. The snare drum comprises a top drum head, which is typically the portion of the snare drum that a user strikes. When the top drum head is actuated (e.g., stricken), the bottom head and snare vibrate to produce the desired sound—the sound typical of a snare drum.

The prior art provides for snare drums that comprise a tensioning adjustment device, such as a handle, and tensioning bands connecting the handle and the end of the snare and/or the snare fitting. Some drums with tensioning adjustment devices and tensioning bands are described in commonly owned U.S. Pat. No. 7,902,444 to Good et al., which is fully incorporated by reference herein in its entirety. When in a first position (typically an "up" position), the handle tensions the tensioning bands such that the snare is proximate and/or contacts the bottom drum head of the snare drum. The handle can also act to loosen the tensioning band, such as when it is placed in a second position (typically a "down" position) such that the snare is no longer proximate and/or no longer contacts the bottom drum head. Such devices are typically referred to as "throw-offs," as a user can simply "throw" the handle into the second/downward position such that the snare is "off" the bottom drum head.

FIGS. 1-3 show views of a prior art throw-off device similar to those shown and described in commonly owned U.S. Pat. No. 7,902,444 to Good et al., which is fully incorporated by reference herein in its entirety. A drum 10 has an annular sidewall or shell 10*a* and a bottom head 11. A snare 13 includes snare wires 13*b* which extend transversely across the lower side of the bottom head 11. The snare 13 also includes a fitting 16 to which the snare wires 13*b* attach. A tensioning band 14 is connected to the snare 13, such as at the fitting 16; and also connects to a plate 37. The tensioning band 14 will often be attached to the fitting 16 at two points, and loop around or attach to portions of the plate 37.

The drum 10 includes a mount 21, to which a support arm 24 is pivotally attached via axle 26. A throw-off handle 33 is pivotally attached to the support arm 24 via axle 32. The throw-off handle 33 in FIG. 1 is primarily shown in its upward position. The throw-off handle 33 is typically biased into the upward position, such as using a torsion spring, though this torsion spring force by itself is typically easily overcome so as to place the throw-off handle in a non-upward/downward position, as will be further described below.

The plate 37 is attached to the handle 33. As can be seen in FIG. 1, when the handle 33 is in its upward position 33*a*, the plate 37 is further from the snare 13, and thus the tensioning band 14 is tensioned such that the snare 13 is engaged with the bottom head 11. A snare sound will therefore be produced when the drum 10 is played. When the handle 33 is in its downward position 33*b*, the plate is in a position 37*a* that is nearer to the snare 13, and thus the tensioning band 14 is loosened and the snare is disengaged from the bottom head 11. Thus when the drum is played, no snare sound will be produced.

An adjuster 60 is used to fine-tune the position of the support arm 24 relative to the sidewall 10*a* of the drum 10, thus fine tuning the amount of tension in the tensioning band 14. This in turn adjusts the tightness with which the snare wires 13*b* are held against the bottom head 11, thus affecting the sound of the drum 10 when played. The support arm 24 includes a magnet 50, and the handle 33 includes a steel disc 75 that engages the magnet 50 when the handle 33 is in an upward position. This attraction between the magnet 50 and the steel disc 75 makes it more difficult for the handle 33 to be removed from its upward position, thus helping to prevent accidental movement of the handle 33 to the downward position and disengagement of the snare 13 from the bottom head 11.

Other related prior art devices are described in U.S. Pat. No. 7,700,864 to Sikra, U.S. Pat. No. 8,143,507 to Good et al., and U.S. Pub. No. 2018/0204550 to Steinhauser, each of which is commonly owned with the present application, and each of which is fully incorporated by reference herein in its entirety.

SUMMARY OF THE DISCLOSURE

The present disclosure relates generally to the field of instruments, such as percussion instruments and musical drums. The disclosure relates more particularly to devices related to throw-offs, such as snare drum throw-offs.

One embodiment of a throw-off device according to the present disclosure includes a mount for mounting to a drum sidewall, and a handle. One of the mount and handle includes a magnet, and the other of the mount and handle includes a magnetic portion for engaging the magnet. When the handle is in an upward position the magnet and magnetic portion are engaged, and when the handle is in a distal position the magnet and magnetic portion are not engaged.

Another embodiment of a throw-off device according to the present disclosure includes a mount for mounting to a drum sidewall, and a handle. One of the mount and handle includes a magnet, and the other of the mount and handle includes a magnetic portion for engaging the magnet. When the handle is in a distal position the magnet and magnetic portion are engaged, and when the handle is in an upward position the magnet and magnetic portion are not engaged.

One embodiment of a drum according to the present disclosure includes a drum with a sidewall, and either of the above two throw-off devices attached to the sidewall. The drum can also include a bottom head and a snare connected to the throw-off device by a tensioning band. When the handle is in the upward position the snare engages the bottom head, whereas when the handle is in the distal position the snare is disengaged from the bottom head.

Another embodiment of a drum according to the present disclosure includes a sidewall, a bottom head, a snare, a throw-off device, and a tensioning band connecting said snare to said throw-off device. The throw-off device includes a mount and a handle attached to the mount and rotatable between an upward position and a distal position. When the handle is in the upward position, the snare is engaged with the bottom head, and when the handle is in the distal position, the snare is disengaged from the bottom head. One of the mount and the handle includes a magnet while the other includes a magnetic portion for magnetic engagement with the magnet.

This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further features and advantages, will be better understood from the following description when considered in connection with the accompanying figures. It is to be expressly understood, however, that each of the figures is provided for the purpose of illustration and description only and is not intended as a definition of the limits of the present disclosure.

DETAILED DESCRIPTION OF THE DISCLOSURE

Figure 1:
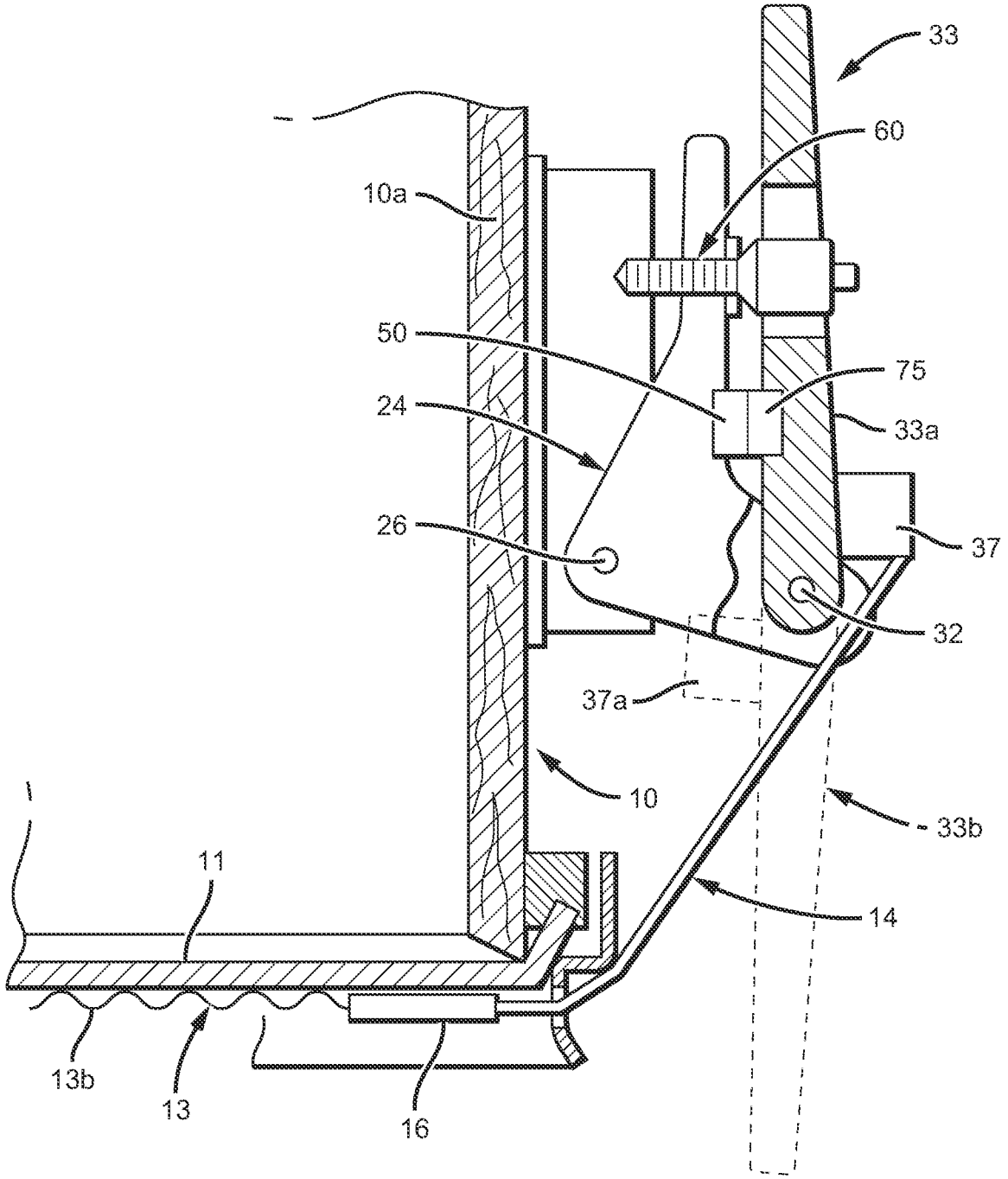
FIG. 1 PRIOR ART
FIG. 1 is a side cross-sectional view of a prior art snare drum.
Figure 2:
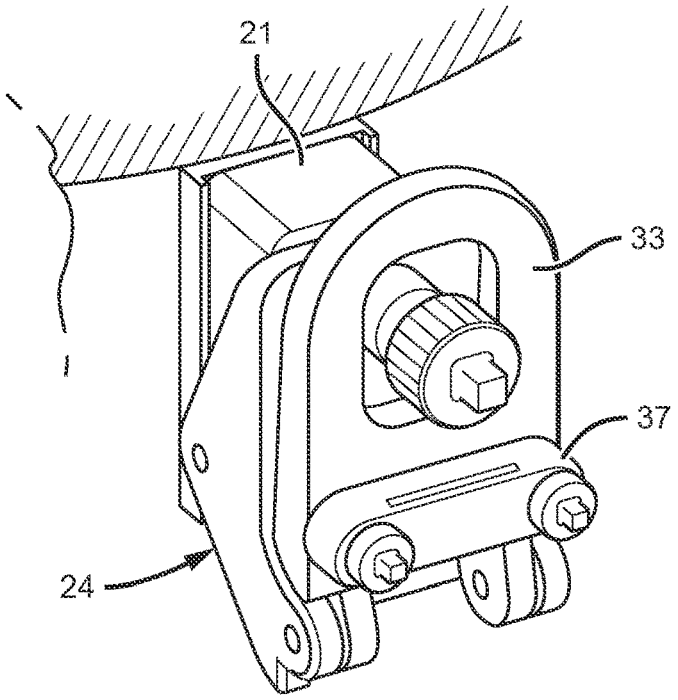
FIG. 2 PRIOR ART
FIG. 2 is a perspective view of the prior art snare drum shown in FIG. 1.
Figure 3:
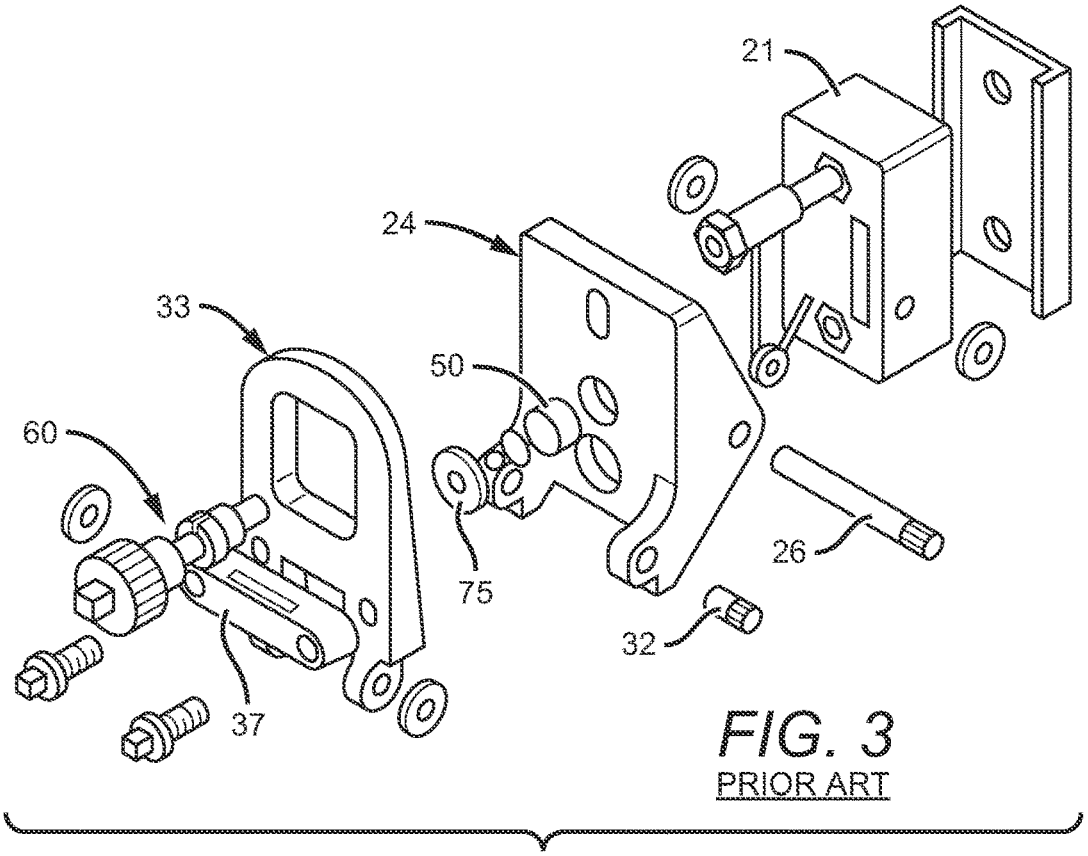
FIG. 3 PRIOR ART
FIG. 3 is an exploded perspective view of the throw-off device shown in FIGS. 1 and 2.
Figure 4:
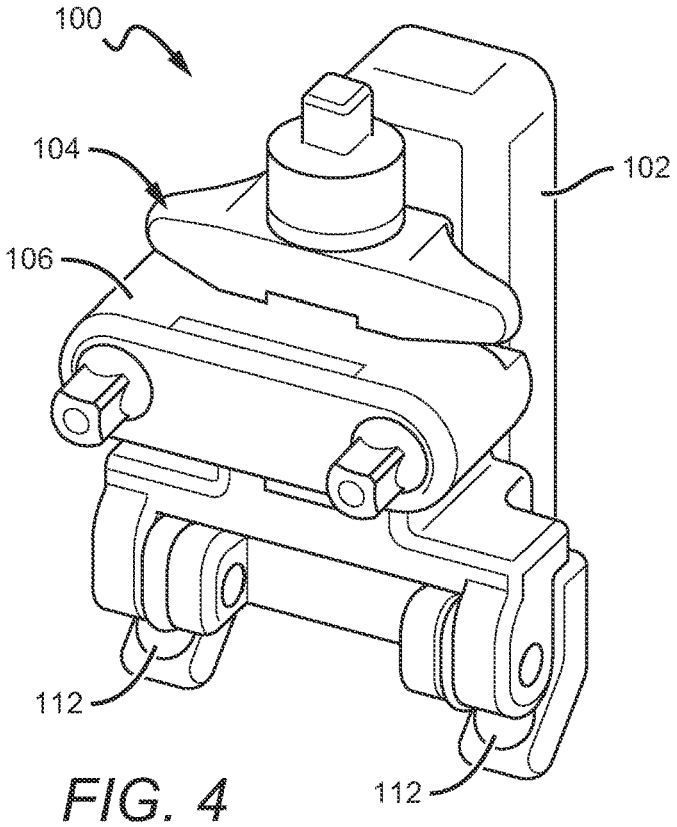
FIG. 4 is a perspective view of a throw-off device according to one embodiment of the present disclosure.
Figure 5:
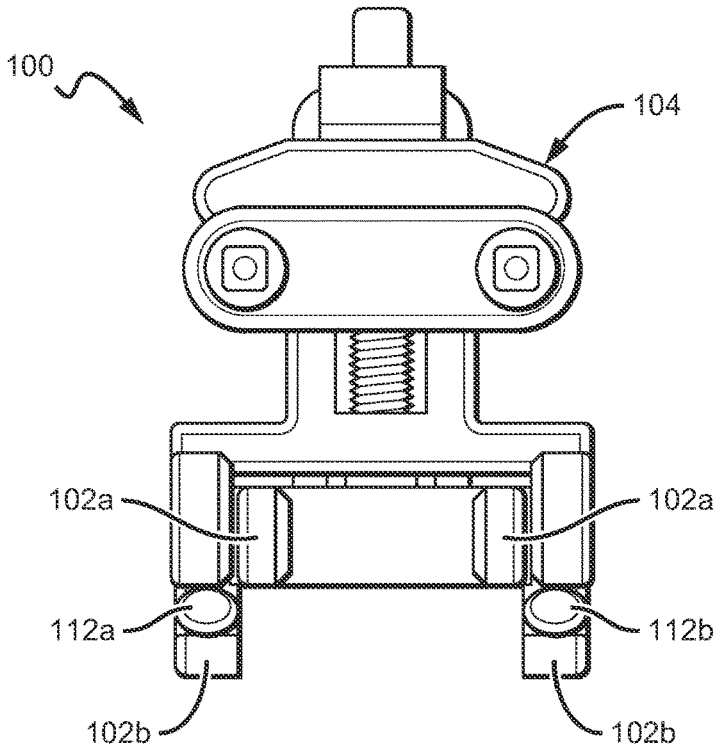
FIG. 5 is a front view of the throw-off device shown in FIG. 4.

The present disclosure relates to percussion instruments and drums, and particularly to snare drums, although it is understood that the concepts, components, systems, and methods described herein can be applied to other instruments. Drums according to the present disclosure can include a throw-off device. As opposed to prior art devices where the throw-off handle is attached to a pivotable support arm, which is then attached to a mount, which is then attached to the drum, the present disclosure describes devices where the throw-off handle is attached to the mount or a projection therefrom. Additionally, whereas prior art devices included a magnet in the pivotable support arm to help to secure the throw-off handle in an upward position, devices according to the present disclosure include a magnet (or accompanying piece for magnetic connection) in or on the mount itself, with the accompanying piece (or the magnet, in the reverse configuration) in the throw-off handle. This can result in a more compact device that is simplified by having fewer components. Finally, devices according to the present disclosure can also include one or more magnets for securing the throw-off handle in a downward position.

It is understood that when an element is referred to as being "on" another element, it can be directly on the other element or intervening elements may also be present. Similarly, if an element is "attached to," "connected to," or similar, another element, it can be directly attached/connected to the other element or intervening elements may also be present. Furthermore, relative terms such as "inner", "outer", "upper", "top", "above", "lower", "bottom", "beneath", "below", and similar terms, may be used herein to describe a relationship of one element to another. Terms such as "higher", "lower", "wider", "narrower", and similar terms, may be used herein to describe angular and/or relative relationships. It is understood that these terms are intended to encompass different orientations of the elements or system in addition to the orientation depicted in the figures.

Although the terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present disclosure.

Embodiments of the disclosure are described herein with reference to view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region and are not intended to limit the scope of the disclosure.

FIGS. 4-6B show one embodiment of a throw-off device 100 according to the present disclosure, which can be attached to a drum such as the drum sidewall. The throw-off device 100 can include a mount 102, which can itself include axle projections 102*a* and magnet projections 102*b*. The mount 102 is configured to attach to a drum, such as the drum sidewall. The throw-off device 100 can further include a throw-off handle 104 (referred to hereinafter as a "handle"), and a projection 106 which can be similar to or the same as the strap plate 37 described in U.S. Pat. No. 7,902,444. Embodiments of the present disclosure can also include plates and/or arrangements such as those described in commonly owned and incorporated U.S. Pub. No. 2018/0204550 to Steinhauser. The throw-off device 100 can further include an axle 108, and magnets 110,112*a*,112*b*.

Figure 6A:
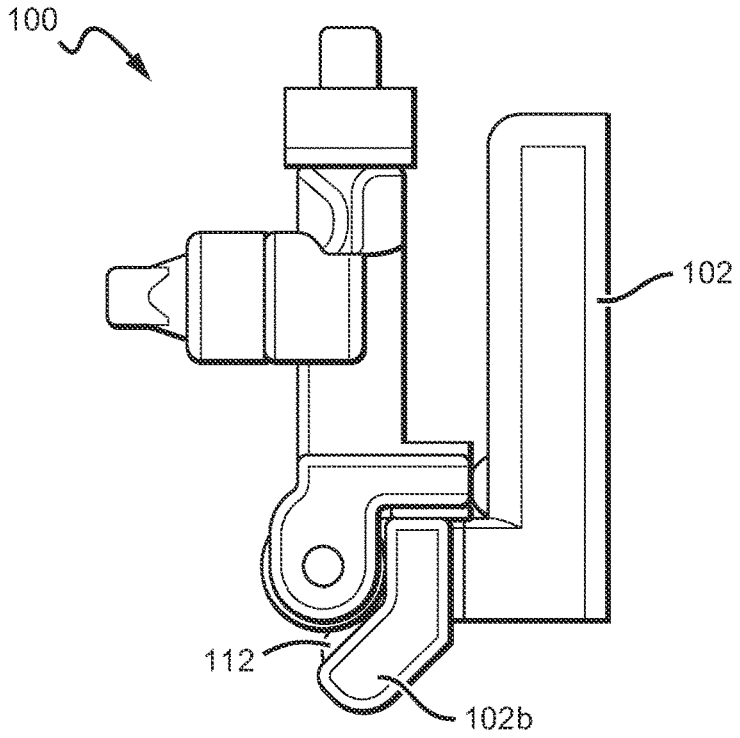
FIG. 6A is a side view of the throw-off device shown in FIG. 4, in a first position.

A tensioning band, such as that described in the prior art, can be attached on one end to a snare on an underside of a drum, and on its other end to the throw-off device 100, such as the projection 106. When the throw-off handle 104 is in its upward position as shown in FIG. 6A, the tensioning bands are tensioned such that the snare engages the bottom drum head. The handle 104 can be attached to the mount 102 via axle 108, which can pass through and/or connect to axle projections 102*a* of the mount 102. It is understood that the axle 108 may include a single physical piece passing through and/or connecting to both axle projections 102*a* and both sides of the handle 104, or may include two separate axles, one for each side. Other embodiments are possible.

Figure 6B:
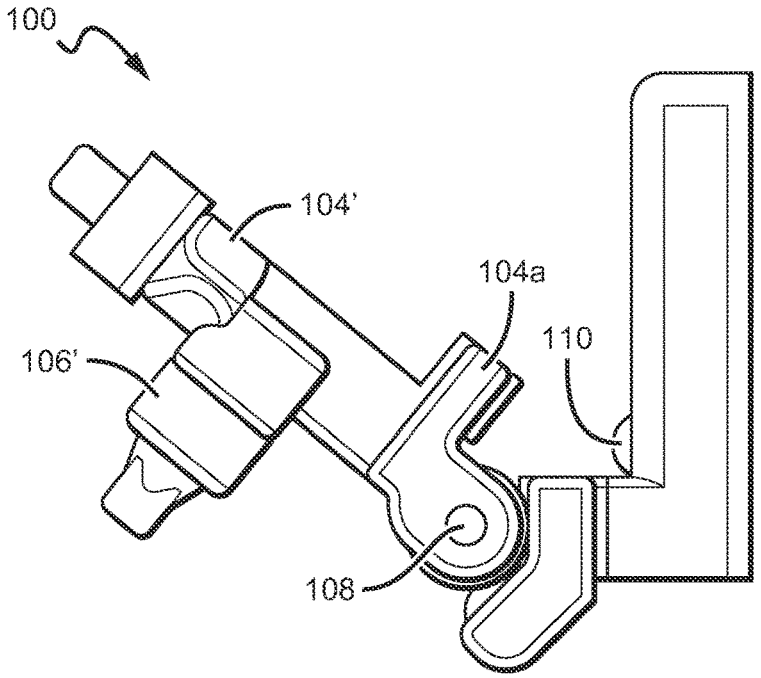
FIG. 6B is a side view of the throw-off device shown in FIG. 4, in a second position.

When the throw-off handle is rotated around axle 108 away from its upward position to, e.g., the position 104' shown in FIG. 6B (referred to herein as a distal position), the projection 106' can be nearer to the snare and/or the tensioning bands can take a more direct route to the snare, such that the tensioning bands are loosened such that the snare is no longer engaged with the bottom drum head. As would be understood by one of ordinary skill in the art, the handle 104 can be held in its upward position by the force from a torsion spring until a user overcomes that force to place the handle 104 in another position. However, the torsion spring force is often relatively weak, meaning that accidental disengagement from the upward position can occur.

The throw-off device 100 can include a magnet 110 that is located on and/or within the mount 102. The magnet 110 can form a magnetic connection with a magnetic portion 104*a* (such as steel, another metal, another magnet, etc.) of the handle 104 when the handle 104 is in an upward (or near upward) position. This can help to avoid accidental disengagement from the upward position by providing another force, other than (or even in place of) the force from the torsion spring, for securing the handle 104 in the upward position. It is understood that while a single magnet 110 is shown, multiple magnets could be used. Additionally, it is understood that while the specific embodiment shown includes the magnet 110 on and/or within the mount 102 and the magnetic portion 104*a* as part of (and/or located on and/or within) the handle 104, the respective locations of the magnet 110 and magnetic portion 104*a* can be reversed. That is, the handle 104 can include the magnet(s) and the mount 102 can include the magnetic portion(s). In some embodiments, the mount 102 and the handle 104 each include one or more magnets and one or more magnetic portions. Many different embodiments are possible.

Additionally, the throw-off device 100 can include one or more magnets for preventing accidental movement into the upward position. One or more magnets 112 (in this case, magnets 112*a*,112*b*) can be used for this purpose. In the specific embodiment shown, the magnets 112 are located on magnet projections 102*b*, which project downwardly from the mount 102. It is understood that the downward projection angle of the projections 102*b* can be short of vertical as shown, vertical, or past vertical, and/or the handle 104 in position 104 can rotate to a position short of horizontal (as shown), horizontal, past horizontal, downwardly vertical, or further; many different embodiments are possible. The projections 102*b* can be a separate piece from the mount 102 (as is shown in the present embodiment), or can be part of the mount 102. The handle 102 can include one or more magnetic portion(s) for forming a magnetic connection with the magnets 112. It is understood that as with the magnetic configuration of the upward position, the locations of the magnet(s) and magnetic portion(s) can be swapped with one another, or both components can include both magnet(s) and magnetic portion(s), etc., as would be understood by one of skill in the art. It is understood that the device 100 can include only magnet(s)/magnetic portion(s) for the upward portion, only magnet(s)/magnetic portion(s) for the distal position, or both. Many different embodiments are possible.

Figure 7A:
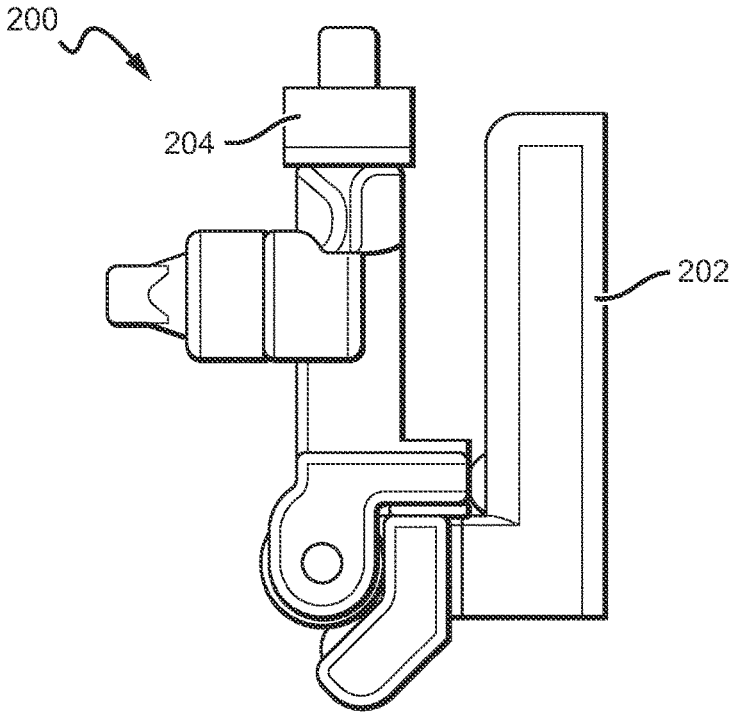
FIG. 7A is a side view of a throw-off device according to another embodiment of the present disclosure.
Figure 7B:
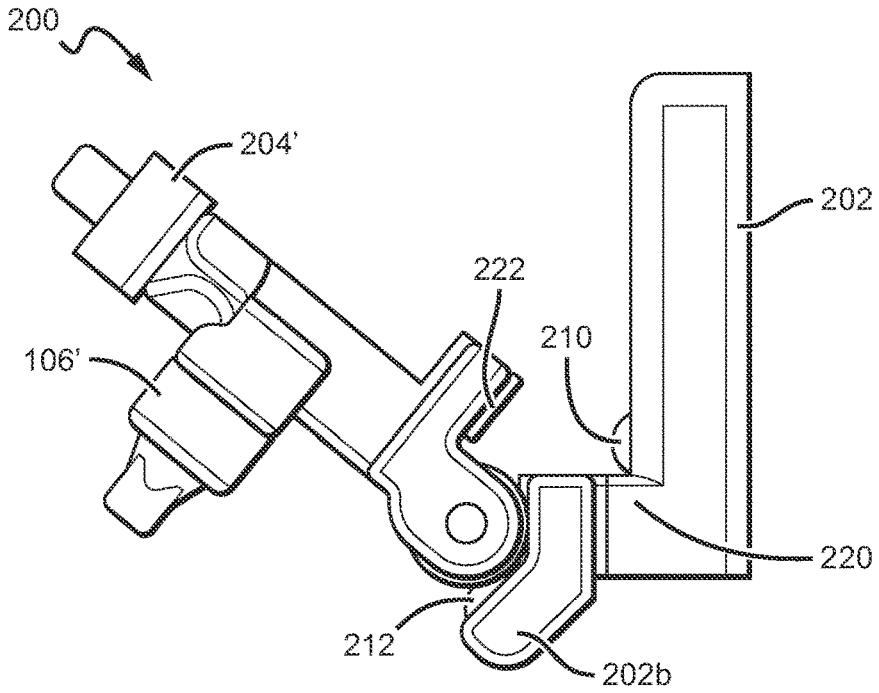
FIG. 7B is a side view of the throw-off device shown in FIG. 7A, in a second position.

FIGS. 7A and 7B are side views of a throw-off device 200 according to another embodiment of the present disclosure. The device 200 is substantially similar to the device 100, except that elements 210 and 212 are mechanical in nature instead of magnetic. In device 200, a magnet is included within the mount 202 approximately at the location 220 at the base of the mount 202 (though other locations are possible). The handle 204 includes a magnetic portion 222 such that when the handle 204 is in or near the upward position shown in FIG. 7A, a magnetic attraction exists between the internal magnet and the magnetic portion 222; and once the handle 204 moves far enough away from the magnet such as to a distal position 204', no magnetic attraction exists. In other embodiments, element 222 may be a magnet and/or a magnet may be internal to the handle 204, and the mount 202 can include one or more magnetic portions, such as internally and/or on the surface where element 222 meets the mount 202 as shown in FIG. 7A.

Similarly, a magnet may be included within the projections 202*b* and/or the handle 204 can include a magnetic portions for connection to these internal magnets (or vice versa, the handle can include magnet(s) and the projections can include magnetic portion(s)). Many different embodiments are possible, and this can be applied to one projection 202*b*, two projections 202*b*, or more. Combinations of the magnetic arrangements of the devices 100,200 are possible.

It is understood that embodiments presented herein are meant to be exemplary. Embodiments of the present disclosure can comprise any combination of compatible features shown in the various figures, and these embodiments should not be limited to those expressly illustrated and discussed.

Although the present disclosure has been described in detail with reference to certain preferred configurations thereof, other versions are possible. Therefore, the spirit and scope of the disclosure should not be limited to the versions described above.

The foregoing is intended to cover all modifications and alternative constructions falling within the spirit and scope of the disclosure as expressed in the appended claims, wherein no portion of the disclosure is intended, expressly or implicitly, to be dedicated to the public domain if not set forth in the claims.

I claim:

1. A throw-off device, comprising:

a mount; and a handle attached to said mount and rotatable between an upward position and a distal position;

wherein one of said mount and said handle comprises a first magnet, and the other of said mount and said handle comprises a first magnetic portion;

wherein said first magnet and said first magnetic portion are magnetically engaged when said handle is in said upward position, and are not magnetically engaged when said handle is in said distal position;

wherein one of said mount and said handle comprises a second magnet, and the other of said mount and said handle comprises a second magnetic portion; and wherein said second magnet and said second magnetic portion are magnetically engaged when said handle is in said distal position, and are not magnetically engaged when said handle is in said upward position.

2. The device of claim 1, wherein said mount comprises said first magnet.

3. The device of claim 1, wherein said first magnet is on or within a body of said mount.

4. The device of claim 1, wherein said first magnet is on a body of said mount.

5. The device of claim 1, wherein said first magnet is within a body of said mount.

6. The device of claim 1, wherein said handle is rotatable about an axle, said axle attached to at least one axle projection of said mount.

7. The device of claim 6, wherein said axle comprises two axles and said at least one axle projection comprises two axle projections, each of said axles attached to a respective one of said axle projections.

8. The device of claim 1, wherein one of said mount and said handle comprises a third magnet, and the other of said mount and said handle comprises a third magnetic portion;

wherein said third magnet and said third magnetic portion are magnetically engaged when said handle is in said distal position, and are not magnetically engaged when said handle is in said upward position;

wherein said mount comprises first and second downward projections; and wherein said second magnet or said second magnetic portion is on said first downward projection, and said third magnet or said third magnetic portion is on said second downward projection.

9. The device of claim 1, wherein said magnetic portion is metallic.

10. The device of claim 1, wherein said first magnetic portion comprises another magnet.

11. The device of claim 1, wherein said first magnet and said first magnetic portion bias said handle toward said sidewall when engaged, and wherein said second magnet and said second magnetic portion bias said handle away from said upward position when engaged.

12. The device of claim 1, wherein said mount comprises a projection, and wherein said second magnet or said second magnetic portion is on said projection.

13. The device of claim 12, wherein said projection is a downward projection.

14. The device of claim 1, wherein said mount comprises said second magnet and said handle comprises said second magnetic portion.

15. The device of claim 1, wherein said second magnet comprises a plurality of magnets and said second magnetic portion comprises a plurality of magnetic portions.

16. A throw-off device, comprising:

a mount; and a handle attached to said mount and rotatable between an upward position and a distal position;

wherein one of said mount and said handle comprises a magnet, and the other of said mount and said handle comprises a magnetic portion; and wherein said magnet and said magnetic portion are magnetically engaged when said handle is in said distal position, and are not magnetically engaged when said handle is in said upward position.

17. A drum, comprising:

a sidewall;

a bottom head;

a snare;

a throw-off device attached to said sidewall, said throw-off device comprising a mount attached directly to said sidewall, and further comprising a handle attached directly to said mount and rotatable between an upward position and a distal position; and a tensioning band connecting said snare to said throw-off device;

wherein when said handle is in said upward position said snare is engaged with said bottom head, and when said handle is in said distal position said snare is disengaged from said bottom head;

wherein one of said mount and said handle comprises a magnet, and the other of said mount and said handle comprises a magnetic portion for magnetic engagement with said magnet; and wherein said magnet and said magnetic portion are magnetically engaged when said handle is in said distal position.

18. The drum of claim 17, wherein said magnet is a first magnet and said magnetic portion is a first magnetic portion, wherein one of said mount and said handle comprises a second magnet, and the other of said mount and said handle comprises a second magnetic portion for magnetic engagement with said second magnet, wherein said second magnet and said second magnetic portion are magnetically engaged when said handle is in said upward position so as to bias said handle toward said sidewall.

19. The drum of claim 18, wherein said first magnet and said first magnetic portion are magnetically engaged when said handle is in said distal position so as to bias said handle away from said upward position.

* * * * *